US005265311A

United States Patent [19]

Gard

[11] Patent Number: 5,265,311

[45] Date of Patent: Nov. 30, 1993

[54] SELF CLOSING HINGE

[75] Inventor: E. Scott Gard, Portland, Oreg.

[73] Assignee: Econo Max Manufacturing, Portland, Oreg.

[21] Appl. No.: 809,383

[22] Filed: Dec. 16, 1991

[51] Int. Cl.[5] ..... E05F 1/02

[52] U.S. Cl. ..... 16/312; 16/318; 16/311

[58] Field of Search ..... 16/312, 311, 313, 315, 16/316, 317, 318, 310, 309, 362, 364, 367, 368, 378

[56] References Cited

U.S. PATENT DOCUMENTS

| | | | |
|---|---|---|---|
| 1,944,386 | 1/1934 | Winslow | 16/311 |
| 2,224,232 | 12/1940 | Peters | 16/318 |
| 2,661,495 | 12/1953 | Kalleberg | 16/315 |
| 2,685,103 | 8/1954 | Forkey | 16/318 |
| 2,904,824 | 9/1959 | Kuehl | 16/318 |
| 3,378,881 | 4/1968 | Hentzi . | |
| 3,639,944 | 2/1972 | Mott, Sr. et al. | 16/318 |
| 3,733,650 | 5/1973 | Douglas . | |
| 3,748,688 | 7/1973 | Berkowitz . | |
| 4,030,161 | 6/1977 | Loikitz . | |
| 4,631,777 | 12/1986 | Takimoto | 16/315 |
| 4,697,306 | 10/1987 | Rhodes | 16/317 |

*Primary Examiner*—Lowell A. Larson
*Assistant Examiner*—Michael J. McKeon
*Attorney, Agent, or Firm*—Klarquist, Sparkman, Campbell, Leigh & Whinston

[57] ABSTRACT

For swingably mounting a door on a jamb, a dual action self closing hinge has a stationary component which seals, shields, and carries a stationary cam and a rotatable cam follower. The cam elements cooperate with one another to displace the cam follower and attached door panel upwardly during an opening movement and permit the automatic downward movement of the cam follower and door panel upon release of the door panel from an open position. Simultaneous with the cam action, an offset hinge mechanism elevates the center of gravity of the door panel during opening, and likewise provides for the automatic return of the door panel to the closed position to improve the self-closing action of the door. In addition, a cam angular position lock enables the closed position of the door relative to the jamb to be easily adjusted.

7 Claims, 3 Drawing Sheets

FIG. 4
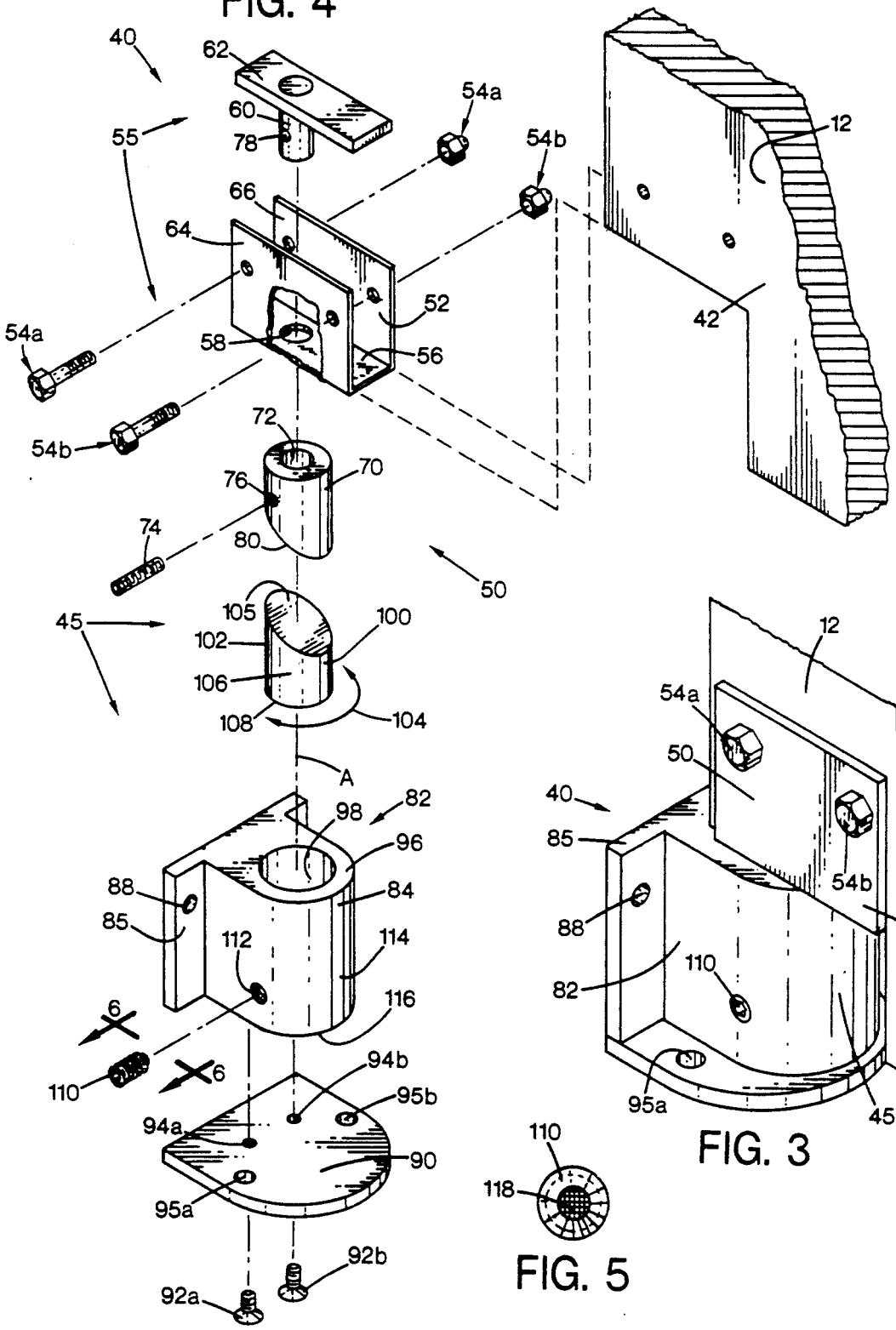
FIG. 5
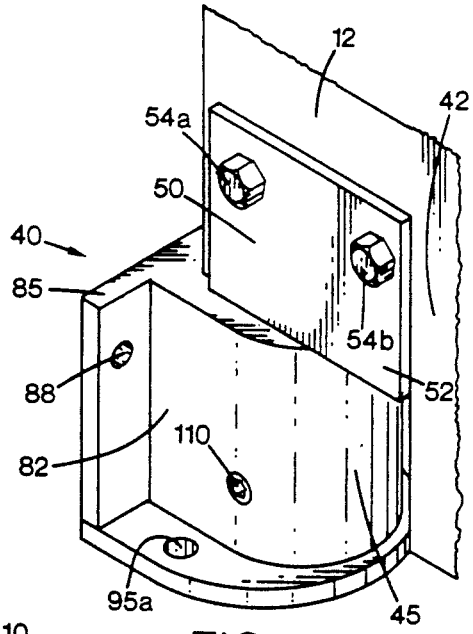
FIG. 3

FIG. 6
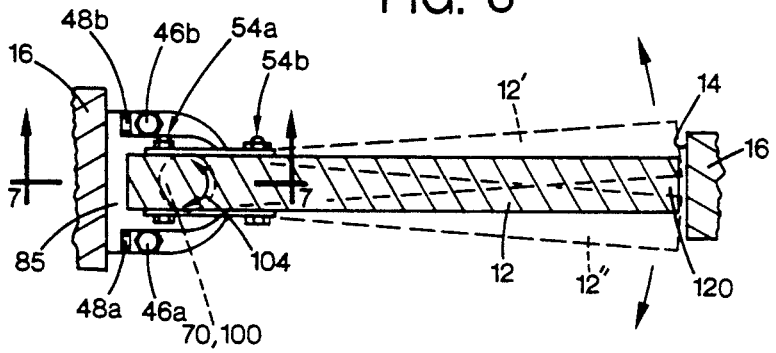
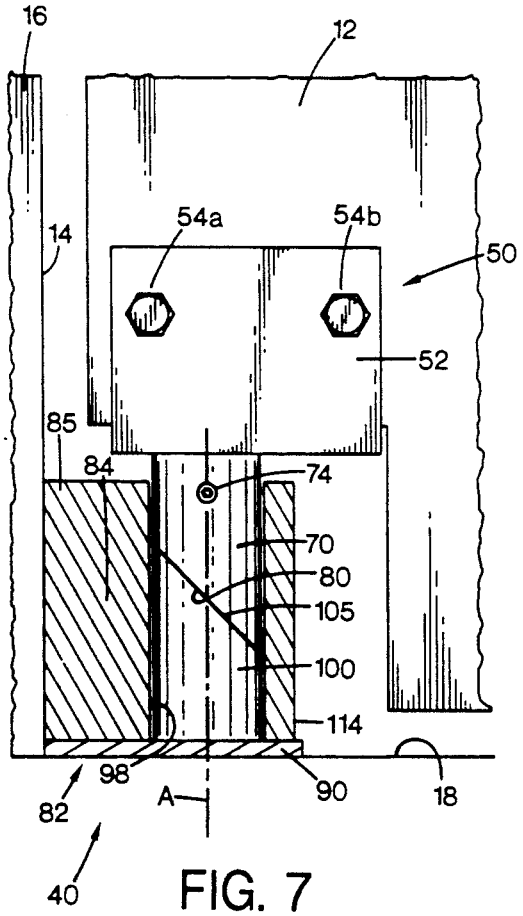
FIG. 7
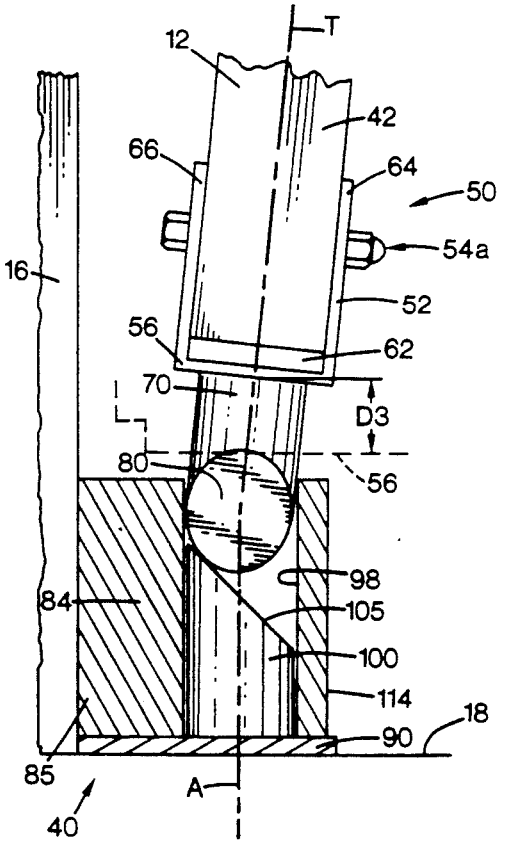
FIG. 8

SELF CLOSING HINGE

BACKGROUND OF THE INVENTION

The present invention relates generally to door hinges, and more particularly to gravity activated, self closing door hinges. Such hinges may be used in high traffic, restaurant kitchen swing doors requiring a full range of swing to both sides of the door frame, and in refrigerator doors requiring a range of motion to only one side of the door frame.

A typical gravity activated, self closing door hinge has a door jamb mounting structure and a pivot post for supporting a door panel. The hinge also has a complementary cam arrangement coupling the jamb mounting structure and the pivot post together in a manner which biases the door panel to a closed position. When closed, the weight of the door panel is transferred through the pivot post to the interface of the complementary cam faces to maintain contact between the cam faces. When the door is opened, an upper rotatable cam face slides across a lower fixed cam face, resulting in the upper cam, pivot post, and door panel being elevated above the closed position. When released from an open position, the weight of the door panel causes the upper cam to pivot and drop back to the stable lower position where the door is closed.

These earlier self closing hinges are exposed to potential abuse when mounted on doors in high traffic areas, and many designs cannot withstand this abuse. For example, U.S. Pat. No. 3,733,650 to Douglas teaches a lift-off gravity hinge mechanism with complementary cam members enclosed in a barrel member for use in exterior gate hinges rather than interior door hinges. When the Douglas hinge is opened, the hinge pin is elevated by the cooperating action of the cams. The Douglas hinge is dissembled by lifting the hinge pin out of the lower barrel. Thus, repeated jarrings by heavy objects passing through doors suspended by Douglas hinges may cause dislocation or even complete disassembly during service. This undesirable trait of Douglas represents at least a nuisance, if not a danger of injury.

Another self closing hinge is disclosed in U.S. Pat. No. 3,378,881 to Hentzi. Hentzi teaches a restaurant kitchen style gravity actuated pivot hinge with exposed complementary cam elements carried by a coaxial pivot pin. Upon rotation, the resultant cam action of the Hentzi hinge causes the upper cam to elevate. Under hostile conditions, the Hentzi hinge is vulnerable to damage due to the exposed nature of Hentzi's cam arrangement. The impact of a heavy object on the exposed cam could cause imbalance or damage the cam faces, resulting in a rapid degradation of the hinge. The closing speed of Hentzi's door may be too slow for some applications because the cam mechanism is the sole provider of the closing force.

The possibility of cam damage is minimized in the hinges of U.S. Pat. Nos. 4,631,777 to Takimoto, and 4,030,161 to Loikitz, which teach the shielding and sealing of the cam area. These hinges, however, are undesirable for use in a two way traffic door because they are not designed to enable a door panel to swing to both sides of a door frame. The Takimoto and Loikitz hinges apparently reach the closed position when the door panel contacts the door frame, and thus, neither provides for any closed door position adjustment.

Thus, a need exists for an improved gravity activated, self closing door hinge which is directed toward overcoming, and not susceptible to, the above limitations and disadvantages.

SUMMARY OF THE INVENTION

In accordance with one aspect of the present invention, a self closing door hinge is provided for adjusting a closed door position of a door panel relative to a door jamb. The hinge includes a door receiving axle assembly for receiving a portion of the door panel. The axle assembly has a projecting axle that terminates in a cam follower having a first inclined cam surface. The hinge also has a door jamb mounting assembly for mounting the hinge to the door jamb. The mounting assembly has a body with a chamber formed therein and a cam with a second inclined cam surface within the chamber. The chamber pivotally receives the axle for pivotal motion about a first axis. The first and second inclined cam surfaces are alignable in a face-to-face relationship when the door panel is at rest in a closed position. The hinge also has a cam lock for fixing a predetermined angular position of the cam about the first axis with respect to the door jamb to adjust the closed position of the door panel.

According to another aspect of the invention, a gravity activated hinge system is provided for suspending and automatically closing a door panel having a center of gravity within a door jamb. The hinge system has a lower hinge assembly for pivotally coupling a lower portion of the door panel with a lower portion of the door jamb. The hinge system also has an upper hinge assembly for pivotally coupling an upper portion of the door panel with an upper portion of the door jamb. The upper and lower hinge assemblies may be aligned to pivot the door panel about a tilted axis to elevate the center of gravity of the door panel when opened above a resting point defined when the door panel is closed.

An overall object of the present invention is to provide for a dual action self closing hinge which has an extended service life and a closing action with improved speed and precision.

Another object of the present invention is to provide a rugged hinge which maintains its structural integrity and smooth closing action even when the door panel or hinge are exposed to physical impacts.

An additional object of the present invention is to provide a hinge with a sealed cam arrangement which is shielded from dust and other contaminants.

A further object of the present invention is to provide a hinge which may be installed on either the left or the right side of a door frame, and which enables a full range of opening and closing movement to either side of the door frame.

Yet another object of the present invention is to provide a hinge which facilitates installation and rotational adjustment of the closed position of a door panel relative to the door frame.

Still another object of the present invention is to provide a hinge having a rotational adjustment system for adjusting the closed position of a door panel relative to the door frame, with the rotational adjustment system being substantially impervious to inadvertent adjustment and physical abuse.

The present invention relates the above features and objects individually as well as collectively. These and other objects, features and advantages of the present invention will become apparent to those skilled in the art from the following description and drawings.

BRIEF DESCRIPTION OF THE DRAWINGS

FIG. 3 is an enlarged perspective view of the lower hinge of FIG. 1;

FIG. 4 is an exploded perspective view of the lower hinge of FIG. 3;

FIG. 5 is an enlarged elevational view of one form of a cam lock of the present invention taken along lines 5—5 of FIG. 4;

FIG. 6 is a sectional view taken along lines 6—6 of FIG. 1;

FIG. 7 is an enlarged partially sectional view taken along lines 7—7 of FIG. 6; and FIG. 8 is a partial sectional view of the lower hinge of FIG. 7 shown with the door panel in an open position.

DETAILED DESCRIPTION OF A PREFERRED EMBODIMENT

Figure 2:
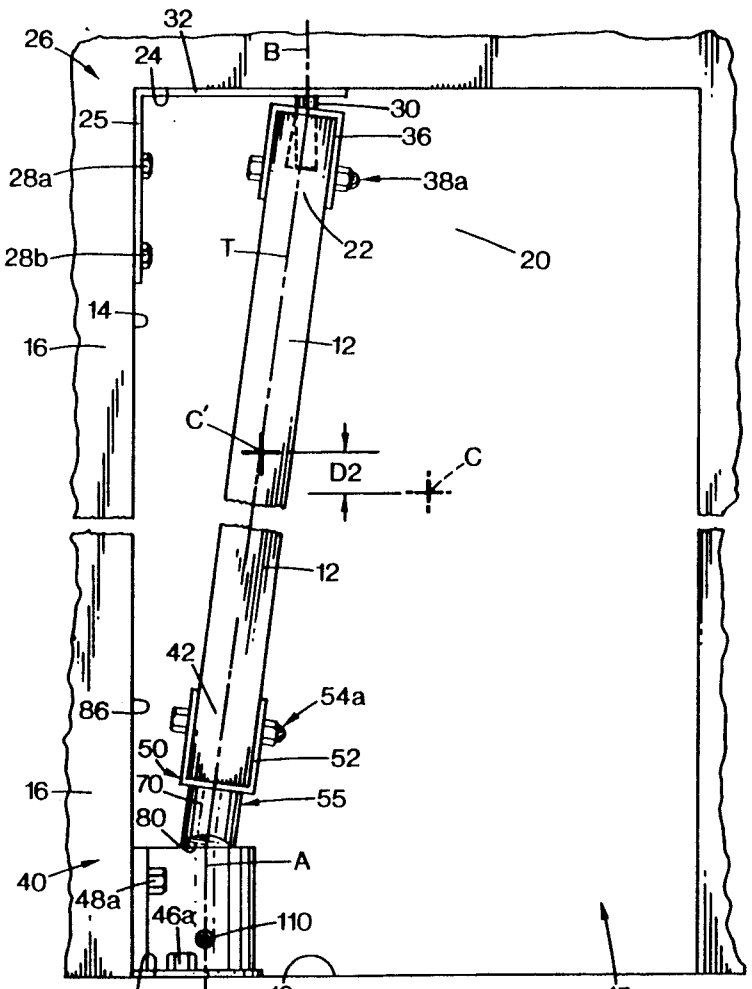
FIG. 2 is a fragmentary elevational view of the mechanism of FIG. 1 with the door shown in an open position.
Figure 1:
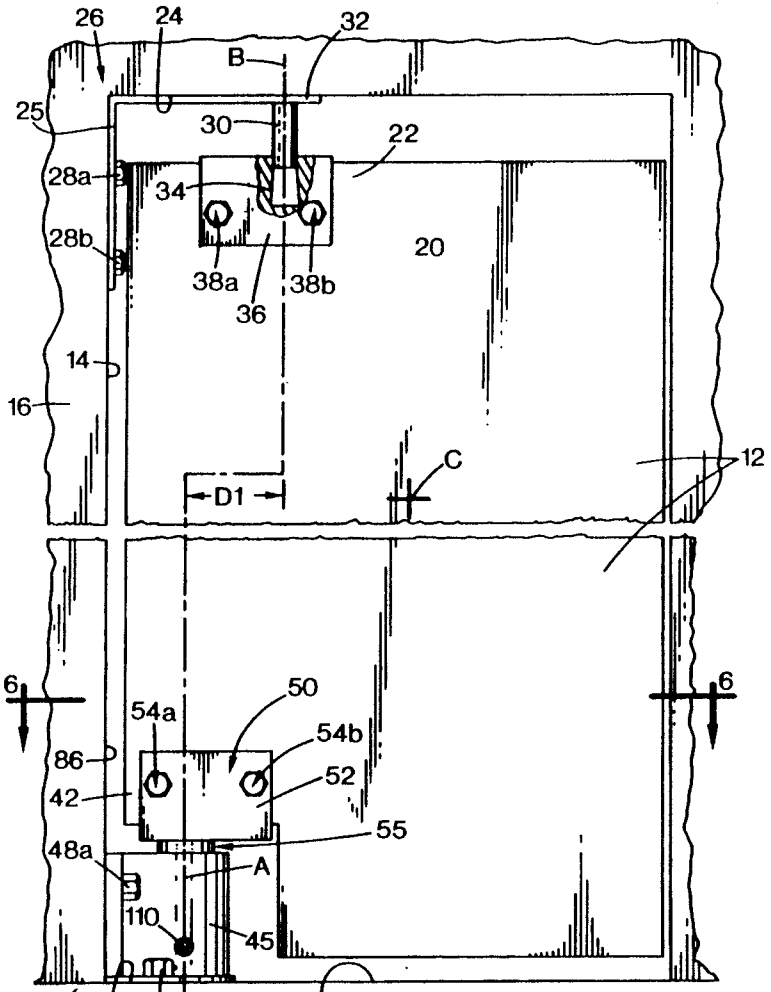
FIG. 1 is a fragmentary front elevational view of one form of an offset hinge mechanism of the present invention shown mounting a swinging door on a door jamb.

Referring to FIGS. 1-2, a gravity activated hinge system 10 constructed in accordance with the present invention is shown pivotally suspending a door panel 12 from a door jamb or frame 14. The door frame 14 defines a doorway 15 through a wall 16 and across a floor portion 18 of the door frame. The hinge system 10 includes an upper hinge assembly 20 for pivotally coupling an upper portion 22 of the door panel 12 with an upper portion 24 of the door jamb 14. In the illustrated embodiment, the upper hinge assembly 20 includes an L-shaped jamb mounting member or corner mounting bracket 25. The bracket 25 may be mounted at an upper corner 26 of the door frame 14 by conventional mounting means, such as lag screws 28*a* and 28*b*.

A pivot post 30 extends downwardly from a horizontal portion 32 of the corner mounting bracket 25. The pivot post 30 is received within a pivot post bushing member 34 recessed within the door panel upper portion 22. The bushing member 34 a depth sufficient to allow the door panel 12 to elevate during the opening of the door as described further below. To prevent excessive wear to the door panel and to add structural integrity and strength to the hinge system, the upper hinge assembly 20 includes a door panel receiving portion, such as a U-shaped panel receiving member or bracket 36. The U-shaped bracket 36 surrounds a portion of the door panel 12 and may be secured to the panel by conventional means, such as bolt and nut assemblies 38*a* and 38*b*.

The hinge system 10 also includes a lower hinge assembly 40 for pivotally coupling a lower portion 42 of the door panel 12 with a lower corner 44 of the door jamb 14. In the illustrated embodiment, the lower hinge assembly 40 includes a door jamb mounting assembly 45 which may be secured to the lower corner 44 by conventional means, such as two pairs of lag screws 46*a*, 46*b* and 48*a*, 48*b* (see FIG. 6) extending into the floor 18 and an upright portion of the door jamb 14, respectively. The lower hinge assembly 40 also includes a door receiving axle assembly 50 having a door panel receiving or mounting member, such as a U-shaped bracket 52. The door mounting bracket 52 may be secured to the door panel lower portion 42 by conventional means, such as bolt and nut assemblies 54*a* and 54*b*. The assembly 50 also has an axle assembly 55 extending downwardly from bracket 52. The axle assembly 55 is pivotally received within the door jamb mounting assembly 45 for pivoting about a first axis A.

The pivot post 30 is located to pivot the door panel 12 about a second pivot axis B. The second pivot axis B is offset from the first pivot axis A by a distance D1 in a direction toward a central portion of the doorway 15. For example, a two inch offset distance D1 on a typical grocery store stock room door provides an approximate 1⅛ inch lift to the distal edge of the door panel opposite the hinged edge. Depending upon the door panel width and weight, as well as the offset distance D1, distal edge lifts ranging from ⅝ to 1½ inches, more or less, are believed to beneficially assist in gravity closing of the door panel.

As shown in FIG. 2, the offset nature of the first and second pivot axes A and B causes the door panel 12 to rotate about a non-vertical, inclined or tilted axis T. The bushing member 34 has a diameter with sufficient clearance to accommodate the pivot post 30 and allow the door to freely open as panel 12 rotates about the axis T. The door panel 12 has a center of gravity C located as shown in FIG. 1 when the door is closed or at rest position (FIG. 1). Opening the door by rotation about axis T elevates the center of gravity to the position C' when in an open position as shown in FIG. 2. Opening the door further than the 90°-open position of FIG. 2, where the door is rotated 90° from a plane defined by the door panel when closed and centered within the frame 14, provides for even greater elevation of this center of gravity.

In the illustrated embodiment, the elevational travel of the center of gravity between the 90°-open and closed positions is shown as distance D2 in FIG. 2. When the door is opened, the potential energy of the door panel 12 increases. Upon release, this increased potential energy translates into kinetic energy as the open door swings back to the closed position under the influence of gravity. This kinetic energy is greater than that achieved with a conventional vertical swing axis. Due to the construction of the illustrated lower hinge assembly 40, discussed in further detail below, the distance D2 is further enhanced over the elevational distance which may be achieved by only offsetting the first and second pivot axes A and B.

Referring to FIGS. 3 and 4, the lower axle assembly 40 is shown in greater detail. The U-shaped door mounting bracket 52 has a lower wall 56 with an axle receiving hole 58 extending therethrough. The axle assembly 55 includes an axle 60 supported by an axle support member 62 in a generally T-shaped configuration. The axle support 62 rests against the lower wall 56 and between upright walls 64 and 66 of bracket 52. The axle support 62 may be welded or otherwise secured to the bracket 52, with the axle 60 extending downwardly through the axle hole 58.

The axle assembly 55 also includes a cam follower member 70 which may be of a machinable injection molded plastic, such as nylon or the like. The cam follower 70 has a hollow bore or socket 72 extending partially therethrough which is sized to receive the axle 60. The cam follower may be secured to the axle 60 by means of a securing member, such as a set screw 74. The set screw 74 extends through hole 76 in the cam follower 70 and into hole 78 within the axle 60. As better shown in FIG. 2, the cam follower 70 includes a first inclined cam surface 80. Thus, with the axle 60 secured within the cam follower bore 72, the axle assembly 55 terminates with the downwardly extending inclined cam surface 80.

The door jamb mounting assembly 45 has a body 82 including a jamb guard member 84. The jamb guard 84 has an upright portion 85 forming flanges for mounting the guard to an upright portion 86 of the door jamb 14. The lag screw 48*a* and 48*b* (see FIG. 6) extend through holes, such as hole 88, extending through the flanges of the upright portion 85. Depending upon the particular application, the jamb guard 84 may be around three inches high as shown in the drawings, or substantially taller, for instance, on the order of nine to twelve inches high. These taller jamb guards (not shown) are particularly useful for harsh environments, such as for mounting doors through which forklifts regularly pass.

The body 82 may also include an optional floor plate member 90 which is secured to a lower portion of the jamb guard 84, for example using screws 92*a* and 92*b*. The screws 92*a* and 92*b* extend through holes 94*a* and 94*b* within the floor plate 90 and into threaded holes (not shown) within the jamb guard 84. The floor plate 92 has two floor mounting holes 95*a* and 95*b* for receiving the respective lag screws 46*a* and 46*b* (see FIG. 6). An outer wall portion 96 of the jamb guard 84 cooperates with the floor 18, or with the floor plate 90 if used, to define a cam and cam follower receiving chamber 98 within the body 82.

The door jamb mounting assembly 45 also includes a cam member 100 which is received within chamber 98. The cam 100 has an upright vertical surface 102 sized to be slidably and pivotally or rotatably received within chamber 98. The cam 100 may rotate within chamber 98 as indicated by arrow 104 in FIG. 4. The cam 100 includes a second inclined cam surface 105 configured to be alignable with the cam follower surface 80 in complimentary contact, such as a face-to-face relationship (see FIG. 7), when the door is closed. The upright wall 102 of the cam 100 includes a lower locking portion 106 located beneath the cam surface 105. The cam 100 has a lower surface 108 which rests against the floor 18 or floor plate 90 when the cam 100 is seated within chamber 98.

The lower hinge 40 has a cam lock including a locking member, such as an externally threaded set screw 110, for selectively coupling the cam 100 with respect to body 82 to fix the cam 100 at a predetermined angular position about axis A. The jamb guard 84 has a threaded hole 112 extending therethrough from an outer surface 114 of the jamb guard to the chamber 98. The cam lock 110 extends through hole 112. The threaded hole 112 is spaced above a lower surface 116 of the jamb guard 84 so the cam lock 110 engages the cam lower locking portion 106 at a predetermined level spaced apart from the second inclined cam surface 105. As shown in FIG. 5, the cam lock 110 terminates in a roughened surface 118, which may be roughened by knurling or the like, to provide a secure frictional fit against the cam locking portion 106. Thus, during use the cam lock roughened surface 118 is prevented from intersecting and damaging the cam surface 105.

As shown in FIG. 6, the closed or at rest position of the door panel 12 may be adjusted with respect to the door frame 14 by rotation of the cam 100 within chamber 98 as indicated by arrow 104. Often during the initial installation or during use, the door panel 12 becomes positioned out of alignment with the door frame 14, such as indicated at position 12′ or position 12″.

A method of realigning the unaligned or ajar door panel to a centered or desired position 120 may be preformed by first disengaging the cam lock 110 by loosening the set screw. As a second step, the door panel 12 is shifted or rotated to position 120, causing cam follower 70 to rotate the cam 100 about axis A due to the face-to-face complementary alignment of the inclined cam surfaces 80 and 105. In a final step, the cam lock 110 is re-engaged by retightening the set screw so the roughened surface 118 grips the cam locking portion 106 to secure the cam 100 in an angular position with respect to body 82.

FIGS. 7 and 8 illustrate the enhancing action of the inclined cam surfaces 80 and 105 to elevate the door panel center of gravity C through the distance D2 (see FIG. 2). In FIG. 7, the door panel 12 is shown at rest with the cam faces 80 and 105 aligned in complimentary face-to-face relationship. This closed position corresponds to the lowest level of potential energy of the door panel 12. In FIG. 8, the door panel 12 is shown in a 90°-open position to allow passage through doorway 15. The inclined nature of the cam surfaces 80 and 105 are shown to elevate the door panel 12 a distance D3, which is less than the distance D2 of FIG. 2. That is, D2 also includes the elevation of the center of gravity due to the tilted axis T provided by the offset nature of the upper and lower hinge assemblies 20 and 40.

As shown in FIGS. 2 and 8, when the door is open, the cam faces 80 and 105 are no longer aligned, and the cam follower 70 has ridden upwardly along surface 105 of the cam 100. This provides for the additional D3 distance of lift, and an increase in the potential energy, of the door panel of the door panel 12 above that obtained through the use of the tilted axis T alone. When released from an open position, the door panel 12 automatically returns to the closed position of FIGS. 1 and 7 under the influence of gravity.

It is apparent that the hinge assembly 40, including the cam lock 110, may be used with a conventionally aligned (non-offset) hinge (not shown) coupling the door panel upper portion 22 to the frame 14. That is, the adjustable feature of hinge assembly, best shown in FIG. 6, may be implemented with a door panel pivoting about a substantially vertical pivot axis (not shown) rather than the tilted axis T.

In operation, as illustrated in FIG. 2, rotation about the tilted axis T tilts the door panel 12 at an angle as the door is rotated in either direction from the closed position, thereby elevating the center of gravity C of the door panel. When the door panel is released from such an open position, the door automatic rotates back about the tilted axis T under the influence of gravity. This automatic closing action drops the door panel center of gravity C to the original stable position when the door rests in the closed position. By itself, the offset nature of the hinge system 10 provides for smooth, automatic closing of the door panel 12.

While the offset nature alone of the hinge mechanism provides a self closing hinge suitable for most applications, the addition of a cam mechanism provides for superior automatic closing action. In the illustrated embodiment, upon the rotation of the door panel from the closed position, the cam action works in tandem with the offset nature of the hinge system 10 to elevate the door panel 12 and provide a self-closing action superior to hinge systems utilizing only a cam mechanism. To provide for a long service life, as well as smooth operation, the cam and the cam follower surfaces may be of hard materials with a low coefficient of friction therebetween. Furthermore, by locking the cam 100 in a desired angular position with respect to the first axis A, the closed position of a door panel 12 may be selected as desired.

As described in the foregoing, the self-closing door hinge according to the present invention has many advantageous characteristics. One major advantage is represented by the cam angular position locking system which allows for the easy adjustment of the closed door position. Thus, the hinge system 10 is ideal for the retrofitting existing doorways. The flexibility of the closed position adjustment results in the hinge system 10 being easily adapted to existing non-square door frames. Thus, hinge system 10 may be used on such imperfect door frames without the need for laboriously squaring the frame prior to hanging the door.

Another important advantage of the illustrated embodiment arises from the superior closing action of the dual action hinge. The cumulative gravity induced closing forces of the cam arrangement when combined with the offset hinges result in a significant improvement in the closing time of the door. This shorter closing time accommodates a higher volume of two way traffic through doorway 15 than is obtainable with conventional hinge systems. Moreover, this improved closing time minimizes the perception of activities and noise occurring on the opposite side of a door, as in the case of a bustling, noisy kitchen preparing food in a quiet restaurant.

The hinge system 10 has an increased service life due to the smooth hinge operation. This service life is extended by substantially isolating the hinge components from exposure to debris causing wear and resulting functional degradation. Thus, the time between required changes of worn cam elements will be significantly increased.

Yet another advantage of this invention is the improved durability of the lower hinge assembly 40 provided by the extensive shielding of the jamb guard 84. The simple, heavily shielded design of the lower hinge assembly 40 results in the cam mechanism being substantially invulnerable to even severe impacts. Likewise, the heavy shielding and rugged design of the cam lock 110 which is substantially flush with the outer wall 114 of the jamb guard, protects the cam lock 110 from impact-induced loosening or damage.

Moreover, the positioning of the lower hinge assembly 40 on the floor 18 at the lower corner of the door frame minimizes the exposure to serious impacts. Such a floor-hugging orientation is usually only exposed to minor impacts from the rubber wheels of vehicles passing through the door, rather than serious impacts from the heavy metal frames of the same vehicles, which usually ride above the wheels. This minimization of severe impacts further enhances the service life of the hinge system 10.

Yet another advantage of this invention is the design of the jamb guard 84, which substantially seals the cam mechanism from the outside environment. This sealing prevents dust and other contaminants from reaching the cam surfaces 80 and 105 of the cam and the cam follower. Thus, cam surface wear and hinge function degradation resulting from such contamination is substantially avoided. This freedom from cam element contamination improves the service life of the hinge.

Finally, unlike many other self closing hinges, the hinge system 10 allows a full range of door motion toward both sides of the plane of the door frame, while retaining the self closing action. This range of motion, as illustrated in FIG. 6, can reach at least 90° on either side of the plane of the door frame, and still close the door panel 12 automatically. Therefore, hinges of this embodiment will maintain their function even when vehicles of a width approaching that of the door frame pass in either direction through the door.

Having illustrated and described the principles of my invention with respect to a preferred embodiment, it should be apparent to those skilled in the art that my invention may be modified in arrangement and detail without departing from such principles. For example, other types of upper hinge assemblies may be used to pivot the door panel upper portion 22. Furthermore, other types of conventional door attachment means may be used which are known to be interchangeable by those skilled in the art and may be substituted herein. I claim all such modifications falling with the scope and spirit of the following claims.

I claim:

1. A self closing door hinge for adjusting a closed door position of an upright door panel relative to a door jamb, the hinge comprising:

a door receiving axle assembly for receiving a portion of the door panel, the axle assembly having a downwardly projecting axle with a lower end which terminates in a cam follower having a first inclined cam surface;

a door jamb mounting assembly for mounting the hinge to the door jamb, the mounting assembly having a body with a chamber which defines a first axis formed therein and a cam with a second inclined cam surface, the cam being positioned within the chamber for pivoting movement about the first axis, with the chamber pivotally receiving the axle and the cam being pivotal in the chamber about the first axis while the axle is within the chamber so as to permit the angular adjustment of the cam surface about the first axis;

the first and second inclined cam surfaces being alignable in a face-to-face relationship when the door panel is at rest in a closed position;

a cam lock for selectively fixing the cam and thereby the cam surface at a desired angular position about the first axis and with respect to the door jamb to adjust the closed position of the door panel;

wherein the door receiving axle assembly further includes:

a door mounting member for receiving a lower portion of the door panel, with the door mounting member having a lower wall with an axle hole extending therethrough;

an axle assembly comprising an upper portion from which the axle is suspended, with the upper portion cooperating with the door mounting member with the axle extending through the axle hole; and a cam follower member having a lower portion terminating in the first inclined cam surface, and an upper portion for fixedly receiving the axle therein.

2. A self closing door hinge for adjusting a closed door position of an upright door panel relative to a door jamb, the hinge comprising:

a door receiving axle assembly for receiving a portion of the door panel, the axle assembly having a downwardly projecting axle with a lower end which terminates in a cam follower having a first inclined cam surface;

a door jamb mounting assembly for mounting the hinge to the door jamb, the mounting assembly having a body with a chamber which defines a first axis formed therein and a cam with a second inclined cam surface, the cam being positioned within the chamber for pivoting movement about the first axis, with the chamber pivotally receiving the axle and the cam being pivotal in the chamber about the first axis while the axle is within the chamber so as to permit the angular adjustment of the cam surface about the first axis;

the first and second inclined cam surfaces being alignable in a face-to-face relationship when the door panel is at rest in a closed position;

a cam lock for selectively fixing the cam and thereby the cam surface at a desired angular position about the first axis and with respect to the door jamb to adjust the closed position of the door panel;

wherein the body of the door jamb mounting assembly comprises:

a jamb guard for mounting to an upright portion of the door jamb, the jamb guard having an outer wall defining a portion of the chamber; and a floor plate for mounting to a floor portion of a doorway defined by the door jamb, the floor plate cooperating with the jamb guard to define the chamber, the floor plate extending outwardly beyond the jamb guard to provide a mounting flange for use in mounting the door jamb mounting assembly to the floor.

3. A self closing door hinge according to claim 2 wherein the jamb guard has a threaded hole extending through the outer wall to the chamber; and the cam lock comprises a threaded locking member threadably engaging the threaded hole through the jamb guard and selectively engaging the cam.

4. A self-closing door hinge for adjusting a closed door position of an upright door panel relative to a door jamb, the hinge comprising:

a door receiving axle assembly for receiving a portion of the door panel, the axle assembly comprising a first U-shaped bracket for mounting to an edge of the door panel, the U-shaped bracket having first and second flanges between which the edge of a door panel is disposed and a base plate interconnecting the first and second flanges, the base plate having an axle receiving opening therethrough, the axle assembly also including an axle support plate and an axle mounted to an axle support plate, the axle having a free end projecting from the axle support plate, the axle being sized for insertion through the axle receiving opening, the axle support plate being sized for positioning between the first and second flanges and against the base plate such that the free end portion of the axle projects through the axle receiving opening and from the base plate and defines a first axis, the axle assembly also including a cam follower mounted to the projecting free end portion of the axle, the cam follower having a first inclined cam surface at a lower end thereof, the cam follower being mounted to the axle for pivoting about the first axis with the pivoting movement of the door between open and closed positions;

a door jamb mounting assembly for mounting the hinge to the door jamb, the mounting assembly having a body with a chamber formed therein and a cam with a second inclined cam surface, the cam being positioned within the chamber, the chamber also pivotally receiving the cam follower such that the cam follower is pivotal about the first axis within the chamber with the movement of the door, the cam being pivotally received in the chamber for movement about the first axis while the axle is within the chamber so as to permit the angular adjustment of the cam surface about the first axis;

the first and second inclined cam surfaces being alignable in a face-to-face relationship when the door panel is at rest in a closed position; and a cam lock for selectively fixing the cam and thereby the cam surface at a desired angular position about the first axis and with respect to the door jamb to adjust the closed position of the door panel.

5. A self closing door hinge according to claim 4 wherein the body of the door jamb mounting assembly comprises:

a jamb guard for mounting to an upright portion of the door jamb, the jamb guard having an outer wall defining a portion of the chamber; and a floor plate for mounting to a floor portion of a doorway defined by the door jamb, the floor plate cooperating with the jamb guard to define the chamber, the floor plate extending outwardly beyond the jamb guard to provide a mounting flange for use in mounting the door jamb mounting assembly to the floor.

6. A self closing door hinge according to claim 5 wherein the jamb guard has a threaded hole extending through the outer wall to the chamber; and the cam lock comprises a threaded locking member threadably engaging the threaded hole through the jamb guard and selectively engaging the cam.

7. An apparatus according to claim 4 including first and second hinge assemblies for pivotally coupling respective upper and lower portions of the door panel to a door jamb, at least one of the hinge assemblies comprising a hinge of claim 4, the first and second hinge assemblies being aligned to pivot the door panel about a tilted axis so as to elevate the center of gravity of the door panel when opened above the center of gravity of the door panel when the door panel is closed.

* * * * *